US005943979A

United States Patent [19]

Hattori

[11] Patent Number: 5,943,979

[45] Date of Patent: Aug. 31, 1999

[54] SEATING AND CONTROL ARRANGEMENT FOR SMALL WATERCRAFT

[75] Inventor: Toshiyuki Hattori, Iwata, Japan

[73] Assignee: Yamaha Hatsudoki Kabushiki Kaisha, Iwata, Japan

[21] Appl. No.: 08/251,306

[22] Filed: May 31, 1994

Related U.S. Application Data

[62] Division of application No. 07/840,309, Feb. 24, 1992, Pat. No. 5,372,082.

[30] Foreign Application Priority Data

Feb. 26, 1991 [JP] Japan ..... 3-53761
Feb. 26, 1991 [JP] Japan ..... 3-53762

[51] Int. Cl.[6] ..... B63P 17/00

[52] U.S. Cl. ..... 114/362; 114/363

[58] Field of Search ..... 114/362–364, 343, 114/188, 194; 441/126, 39; D25/62–64

[56] References Cited

U.S. PATENT DOCUMENTS

| | | | |
|---|---|---|---|
| 42,195 | 4/1864 | Jones . | |
| 2,436,153 | 2/1948 | Sanmori | 280/87 |
| 2,629,356 | 2/1953 | Whiting | 114/144 |
| 2,839,312 | 6/1958 | Barenyi et al. | 280/87 |
| 2,971,601 | 2/1961 | Fortune | 114/362 |
| 3,570,029 | 3/1971 | Hunsaker | 114/362 |
| 3,584,704 | 6/1971 | Eckmann | 114/362 |
| 4,085,473 | 4/1978 | Franklin | 114/362 |
| 4,293,967 | 10/1981 | Ord | 114/362 |
| 4,299,407 | 11/1981 | Simson | 280/775 |
| 4,531,921 | 7/1985 | Teraura et al. | 440/53 |
| 4,548,155 | 10/1985 | Hegg | 114/362 |
| 4,674,354 | 6/1987 | Brand | 74/492 |
| 4,742,795 | 5/1988 | DePrey | 114/362 |
| 4,896,744 | 1/1990 | Crone | 114/362 |
| 5,056,450 | 10/1991 | Mardikian | 114/194 R |
| 5,101,751 | 4/1992 | Kobayashi | 114/114 R |
| 5,123,372 | 6/1992 | Kobayashi | 114/362 |
| 5,255,626 | 10/1993 | Hattori | 114/362 |

FOREIGN PATENT DOCUMENTS

| | | |
|---|---|---|
| 998391 | 1/1952 | France . |
| 883130 | 11/1961 | United Kingdom . |
| 1082380 | 7/1967 | United Kingdom . |

*Primary Examiner*—Robert J. Oberleitner
*Assistant Examiner*—C. T. Bartz
*Attorney, Agent, or Firm*—Knobbe, Martens, Olson & Bear LLP

[57] ABSTRACT

A number of embodiments of small watercraft having a seat that affords at least two different seating positions in generally side by side fashion. A steering control is supported forwardly of the seat and is movable between two different positions, each in front of a respective one of the seating positions while maintaining the steering axis generally perpendicular to the seat and for varying the distance between the steering element and the seat in the respective positions. The support for the steering element is also pivotal about a transversely disposed horizontally extending axis to permit different height positioning for the steering control when it is in its steering position. A variety of seat arrangements and boarding facilitating devices are also disclosed.

1 Claim, 23 Drawing Sheets

SEATING AND CONTROL ARRANGEMENT FOR SMALL WATERCRAFT

CROSS-REFERENCE TO RELATED APPLICATIONS

This application is a division of my application Ser. No. 07/840,309, filed Feb. 24, 1992 now issued as U.S. Pat. No. 5,372,082 on Dec. 13, 1994.

BACKGROUND OF THE INVENTION

This invention relates to a seating and control arrangement for a small watercraft and more particularly to an improved arrangement for facilitating the seating, operation and entry of a small watercraft.

Small personal watercraft are becoming quite popular. This type of watercraft is frequently designed to be operated by an operator wearing a swimming suit, due to the sporting nature of the type of watercraft. Although such watercraft are designed primarily to accommodate a single rider, there are advantages in being able to permit the rider to accommodate one or more passengers. However, because of the small nature of the watercraft, the seating position for varying numbers of occupants can be very important. That is, if the watercraft is balanced with only a single rider, it is important to insure that the balance of the watercraft can be maintained if more than one rider occupies the watercraft.

It is possible to maintain such balance if the seating arrangement for the watercraft is of the tandem type. However, there are a number of advantages to permitting the rider and his passengers to sit side by side. Maintaining side to side balance with side by side seating arrangements does present some problems.

That is, if the watercraft is balanced with only a single rider and a second rider sits alongside the single rider, then the side to side balance may be disturbed. The copending application of Noboro Kobayashi, entitled "Steering Arrangement For Small Watercraft", Ser. No. 07/457,553, filed Dec. 27, 1989 and assigned to the assignee hereof shows a control arrangement for a small watercraft that permits the operator to control the watercraft from a central position when he is the only operator in the watercraft and from a side position when an additional passenger is carried in side by side relationship with the operator. That construction has a number of advantages, as aforenoted.

There are some instances, however, when it is desirable to permit the control of a watercraft from more than one location through a single steering control. However, when the alternate steering positions are chosen, it may also be desirable to provide a different relationship between the steering control and the seat in which the operator is positioned. For example, it may be desirable to provide an arrangement wherein there is a different distance between the steering control and the seat in the alternate seating position. Also, it is desirable to insure that the steering control maintains the same relationship to the seat regardless of the control position.

It is, therefore, a principal object of this invention to provide an improved arrangement for the control and seating in a small watercraft.

It is a further object of this invention to provide a control arrangement for a small watercraft that facilitates the operator being able to operate the watercraft from different positions and also wherein the control has the same relationship to the seat in each position but the control and the seat may be spaced different distances in the various positions.

In addition to various side to side positioning of the steering control, it may also be desirable if the height of the steering control may be different.

It is, therefore, a still further object of this invention to provide an improved steering control for a small watercraft which is movable between a variety of positions and which also is vertically movable.

In connection with the alternate control positions for the watercraft, it also may be desirable to permit the operator to control the watercraft from any of a plurality of positions regardless of whether he has another passenger accompanying him. As has been previously noted, this can adversely effect the side to side balance of the watercraft.

It is, therefore, a further object of this invention to provide a hull and seating construction for a small watercraft wherein the operator may operate the watercraft from either a central position or a side position and wherein the hull of the watercraft has adequate buoyancy to permit this without capsizing.

As is noted, the described type of small watercraft is particularly sporting in nature. Frequently the operator and/or passengers may wear swimming suits, may desire to enter the body of water in which the watercraft is operating for the purpose of swimming, and then reenter the watercraft. In addition, it may be desirable to incorporate some arrangement for facilitating such entry either from the body of water in which the watercraft is operating or from the shore or an adjacent dock.

It is, therefore, a further object of this invention to provide an improved boarding arrangement for a small watercraft that can be easily carried by the hull of the small watercraft, which will not encroach on the passenger's compartment and which will still provide a neat appearance.

In connection with the boarding of the watercraft, if a separate boarding device is not provided or even if one is, it is desirable to permit a rider to enter the watercraft from the body of water in which the watercraft is operating without having undue tilting of the hull. This is particularly true if one rider may be positioned in the watercraft when another is entering.

It is, therefore, a still further object of this invention to provide an improved arrangement for facilitating entry of a passenger onto a small watercraft having a bench type seat and wherein the entry will not cause substantial tilting or leaning of the watercraft.

SUMMARY OF THE INVENTION

A first feature of this invention is adapted to be embodied in a watercraft having a hull defining a rider's compartment and seat means in the rider's compartment defining at least two different, generally side by side seating positions. A steering element is positioned forwardly of the seat means and is rotatable about an axis for steering of the watercraft. Means support the steering element for movement to a position forwardly of either of the seating positions while maintaining the steering axis in a generally perpendicular relationship to the seating means with the seating element being positioned at different longitudinal positions relative to the seating means in each of the positions.

Another feature of the invention is adapted to be incorporated in a watercraft having a hull defining a rider's compartment with a powering internal combustion engine positioned forwardly of the rider's compartment. This engine drives a propulsion device positioned rearwardly of the engine for propelling the watercraft. Seat means are provided in the rider's compartment defining at least two different generally side by side seating positions. A control element is supported by the hull forwardly of the seat means for movement between two different control positions each forwardly of a portion of the seat means and one of the seating positions. The means supporting this control element extends at least in part across the upper portion of the engine. The supporting means is supported for pivotal movement about a transversely extending horizontal axis disposed forwardly of the internal combustion engine so that the control means may be moved vertically in addition to horizontally.

Another feature of the invention may be embodied in a small watercraft having a hull defining a rider's area at the rear of the hull and a seat positioned at the rear of the rider's area and having a seat back. An open area is provided to the rear of the seat to accommodate a standing or entering rider. The seat back forms a handle for grasping by a rider entering the watercraft.

Another feature of the invention is adapted to be embodied in a hull defining a rider's area at the rear of the hull and a seat positioned at the rear of the rider's area and designed to permit a rider to sit either in a central position or at a side position. The hull is provided with a pair of elevated buoyant masses to the rear of the seat and on the sides of the hull for precluding capsizing of the hull if the rider moves to a side position.

Yet another feature of the invention is adapted to be embodied in a watercraft having a hull defining a rider's area that is adapted to accommodate at least one rider therein. The hull has an exterior surface that defines a recess. Boarding means for facilitating entry of the rider into the rider's area for outside of the hull is provided and this boarding means is configured to nest at least in part in the recess when not in use.

DETAILED DESCRIPTION OF THE PREFERRED EMBODIMENTS

Figure 1:
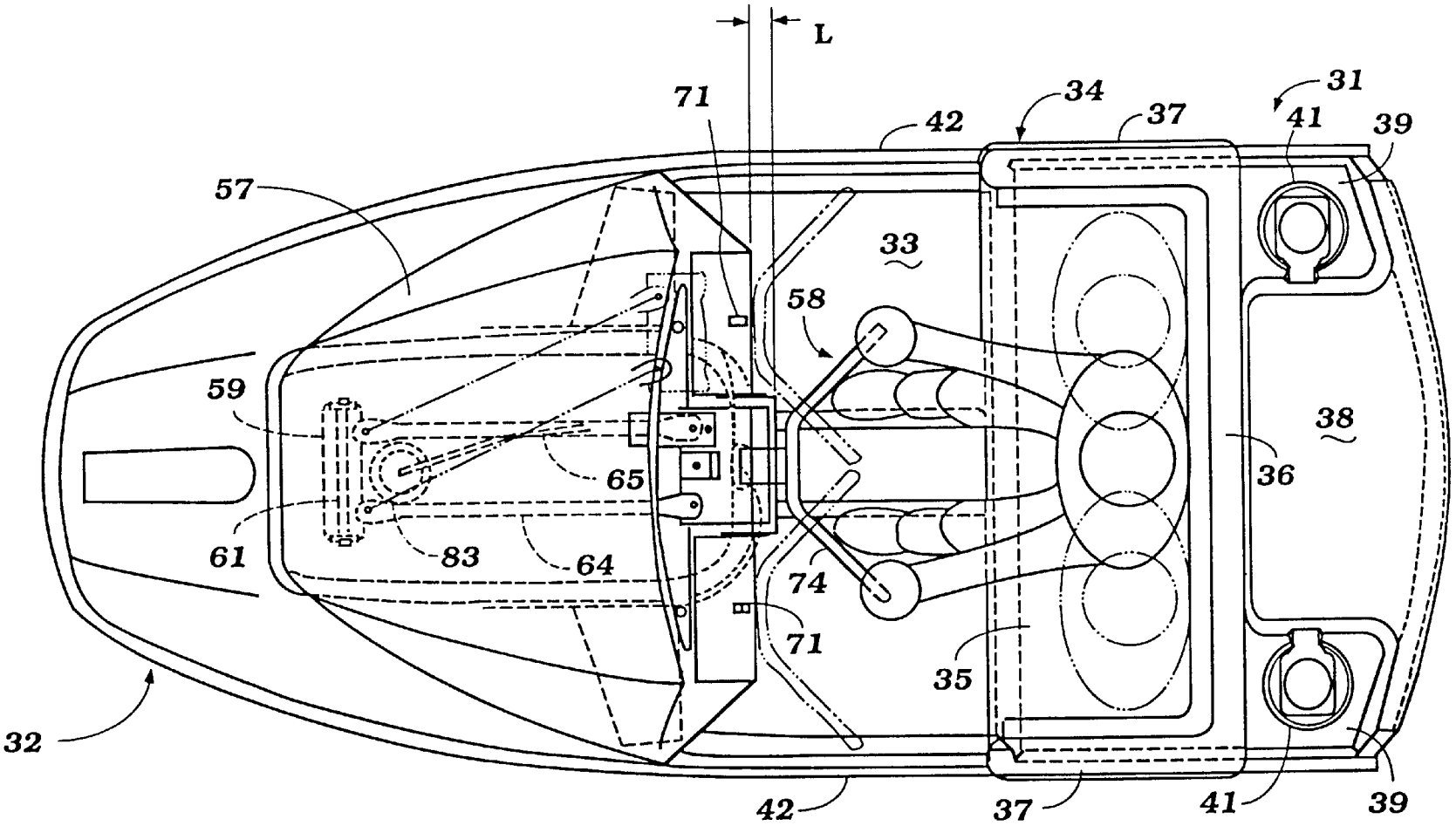
FIG. 1 is a top plan view of a small watercraft constructed in accordance with a first embodiment of the invention showing the central seating and control position in solid lines and alternative side seating and control positions in phantom.
Figure 2:
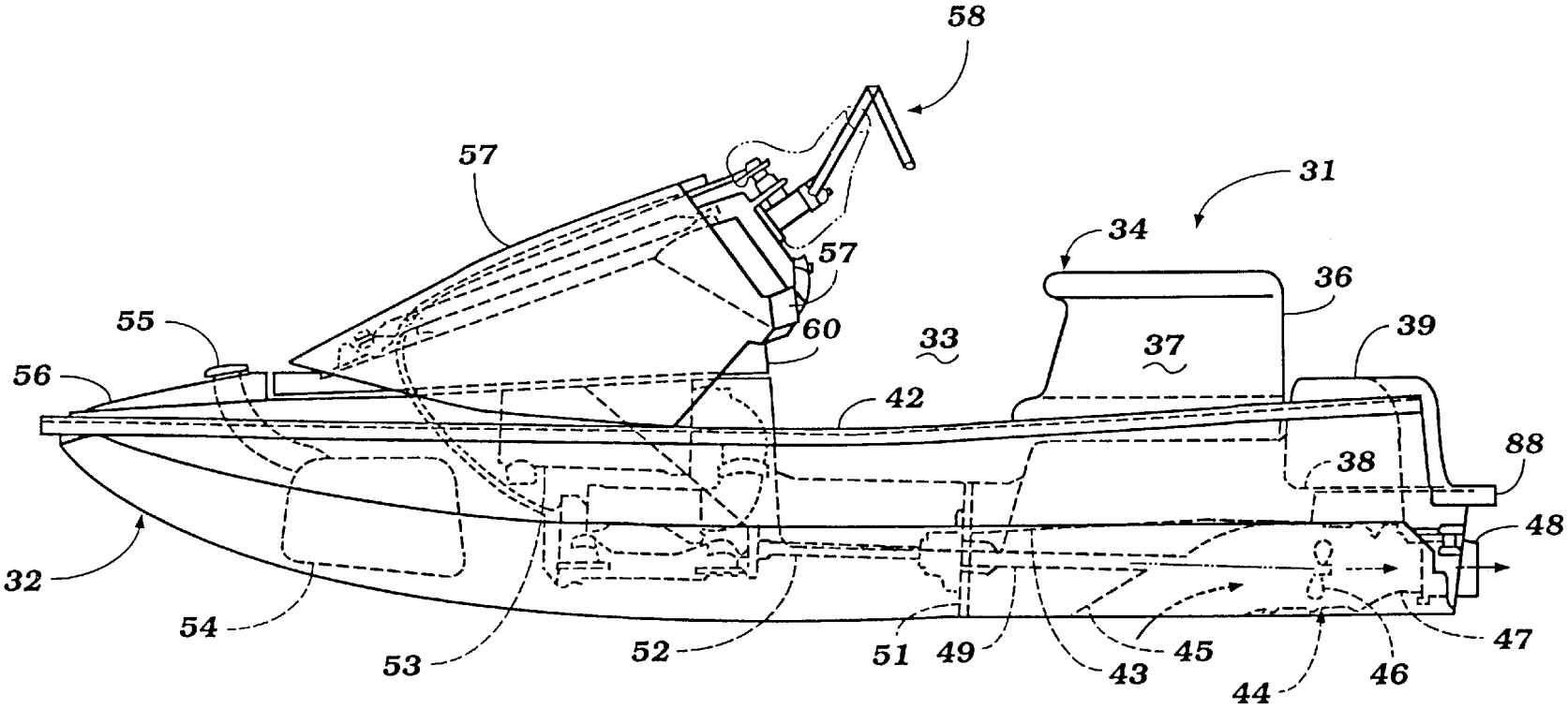
FIG. 2 is a side elevational view of this embodiment.
Figure 3:
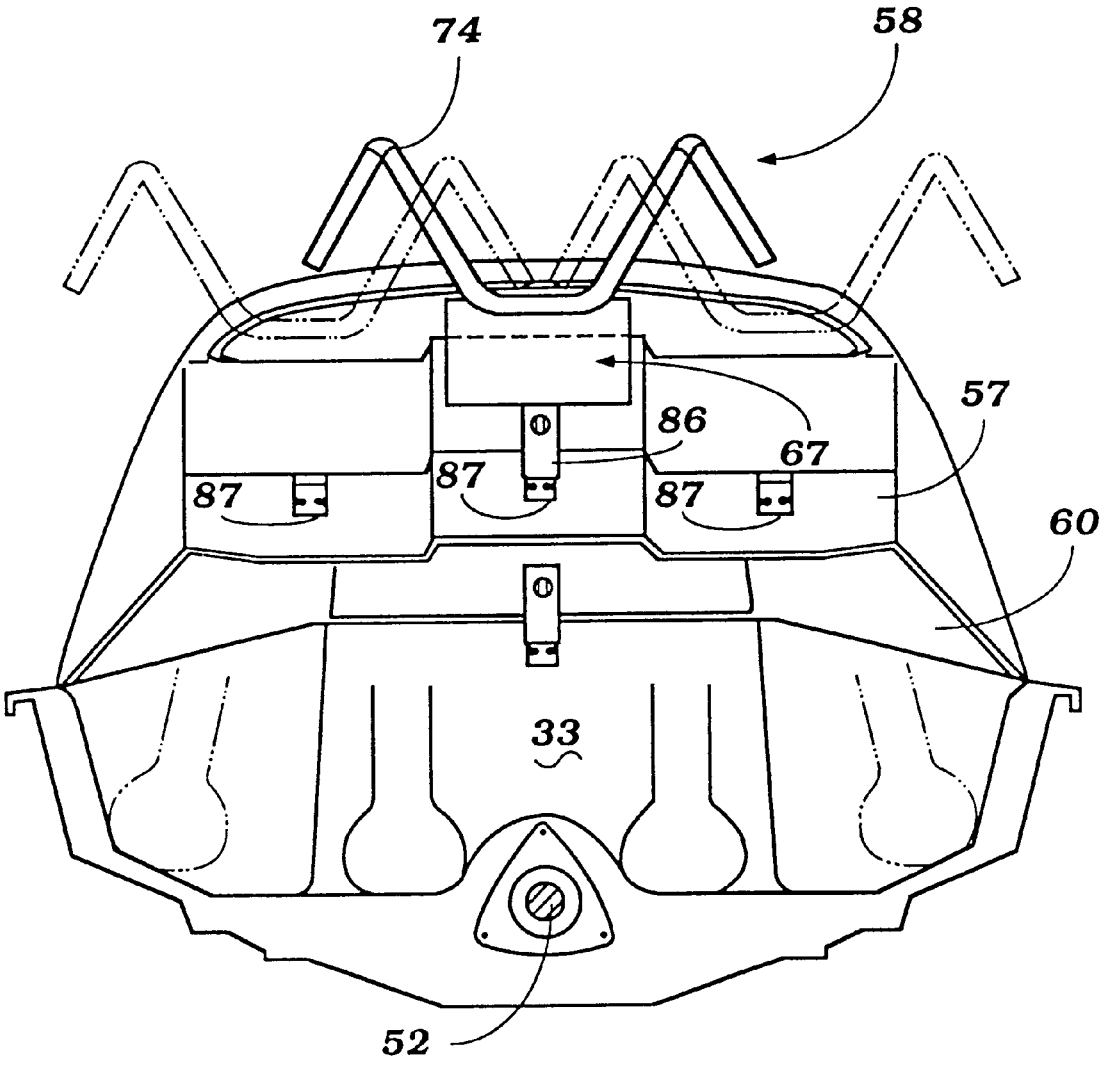
FIG. 3 is a rear elevational view showing the passenger compartment and the alternative control positions looking toward the front of the watercraft.
Figure 4:
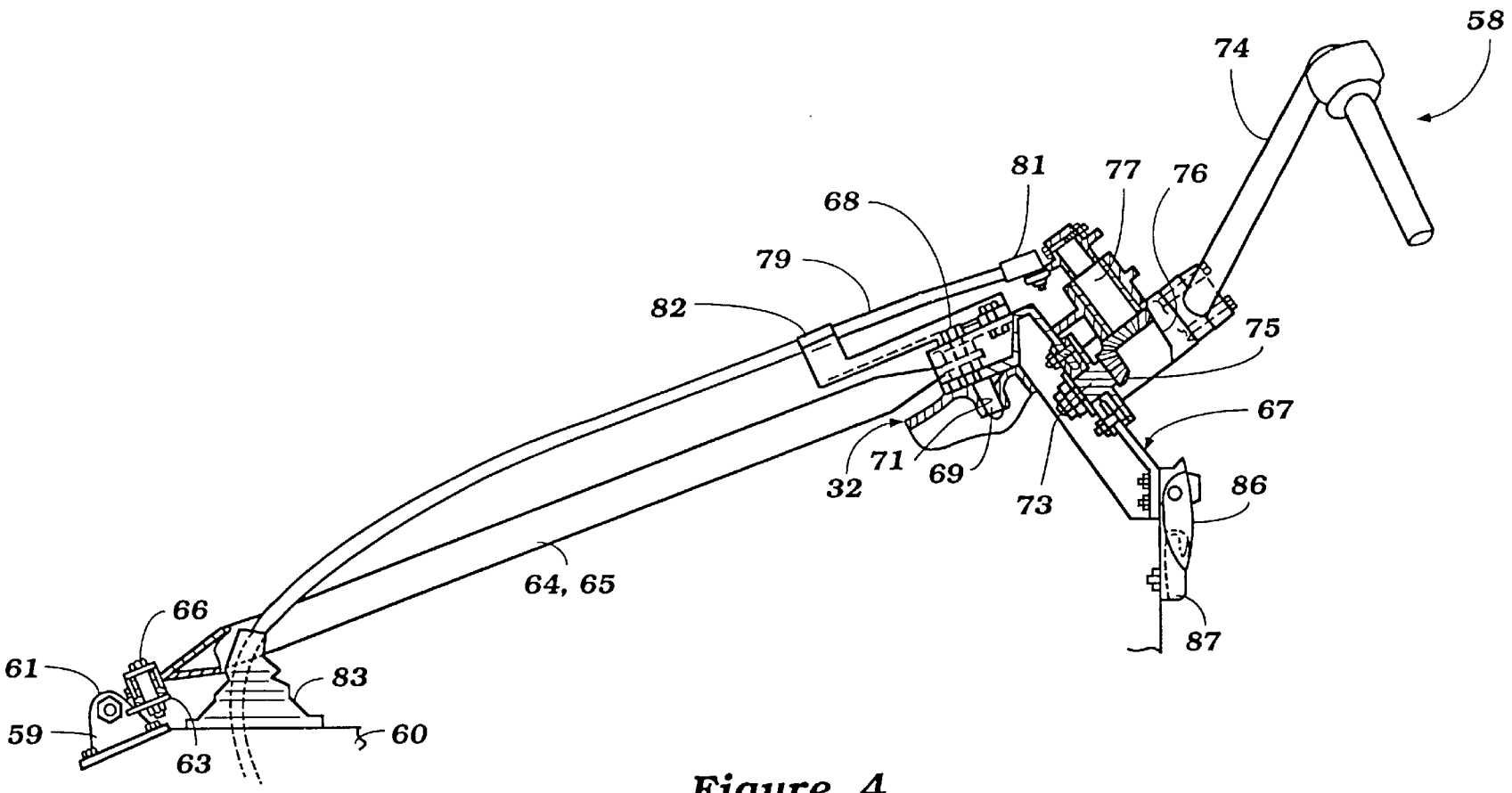
FIG. 4 is an enlarged side elevational view of the control mechanism, with portions broken away.
Figure 5:
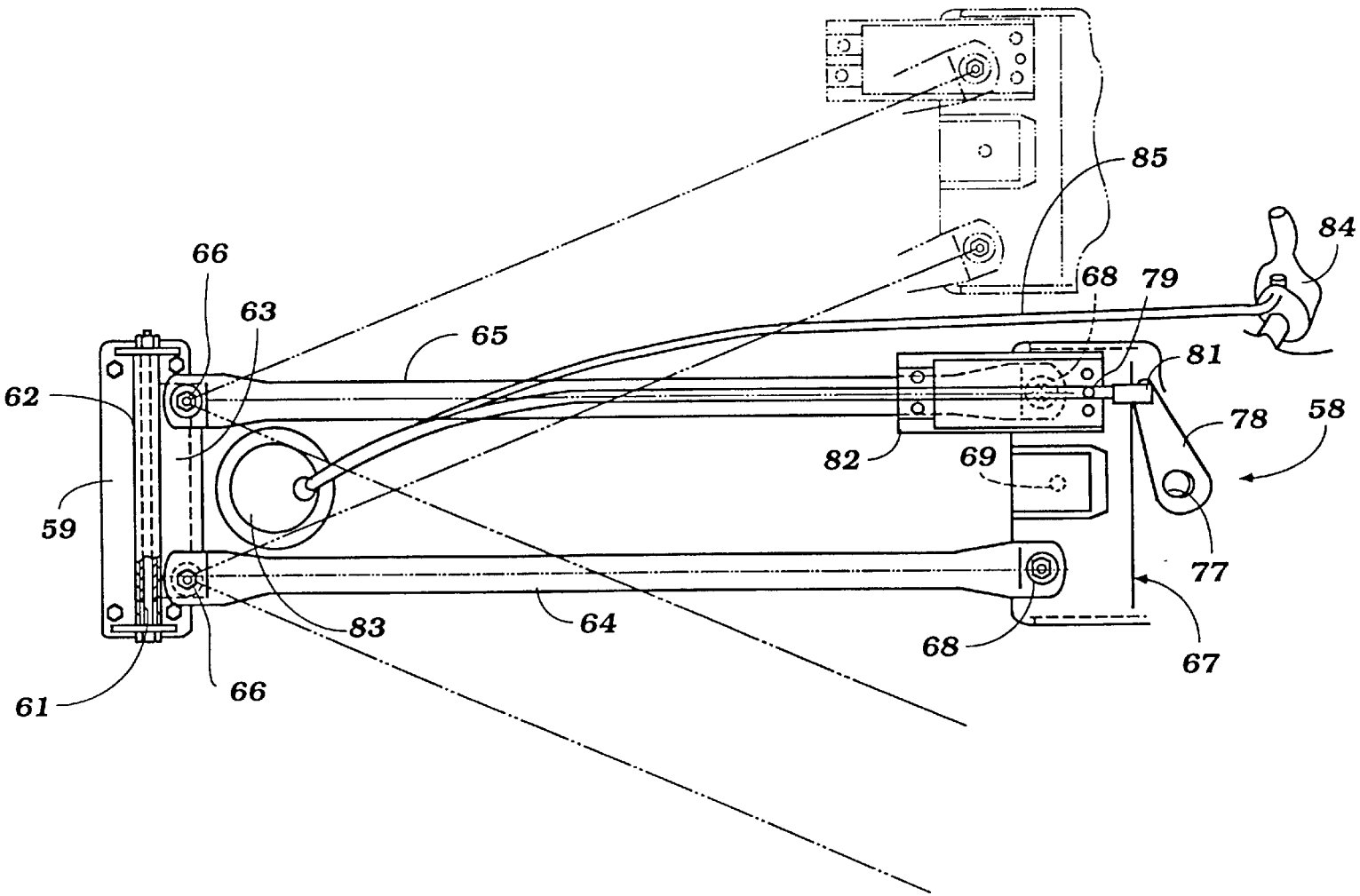
FIG. 5 is a top plan view of the control mechanism showing it in central position in solid lines and in its alternative positions in phantom lines.
Figure 6:
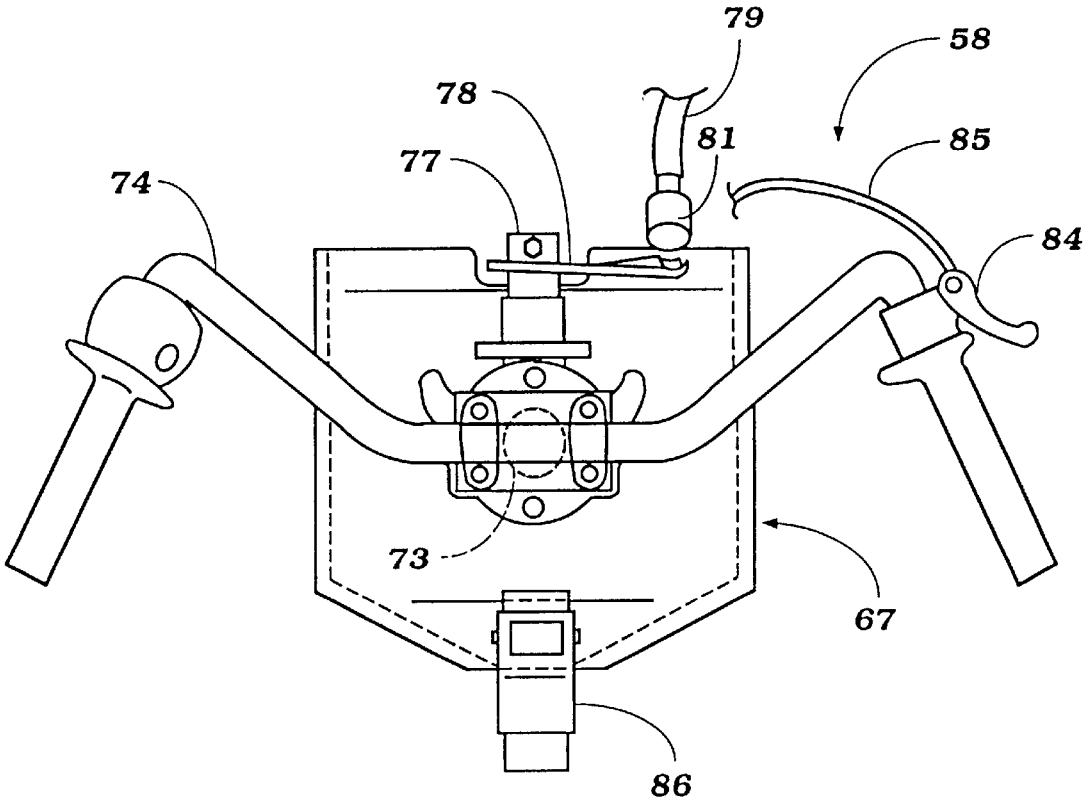
FIG. 6 is a rear elevational view of the control mechanism.

Referring now in detail to the drawings and initially to the embodiment of FIGS. 1 through 9 by initial reference primarily to FIGS. 1 and 2, a small watercraft constructed in accordance with this embodiment is identified generally by the reference numeral 31. The watercraft 31 includes a hull, indicated generally by the reference numeral 32 which is comprised of lower and upper portions formed from a suitable material such as a molded fiberglass reinforced resin. To the rear of the hull 32, there is provided a passenger's area, indicated generally by the reference numeral 33, that is comprised of a seat 34 that is adapted to accommodate either a single rider seated in a central position as shown in the solid line view of FIG. 1 or a rider and passenger seated in side by side relationship with the control, to be described, positioned in front of either side of the seat 34. In this embodiment, the seat 34 includes a cushion 35 having an appropriate width, as aforenoted, a backrest portion 36 and a pair of side bolsters 37.

A small deck 38 is provided behind the seat 34 and is bounded by a pair of elevated side buoyant portions 39, each of which may be provided with a glove or package compartment that is closed by a pivotally supported closure member 41. These compartments also add to the buoyancy of the sides of the rear portion of the hull 32, for a reason which will be described. It should be noted that the deck 38 opens rearwardly of the hull of the watercraft and is disposed at a lower level than the gunnels 42 which extend along the side of the passenger compartment 33 and extend rearwardly to the buoyant areas 39. It should be noted that deck 38 extends forwardly of the transom which lies beneath it as shown in FIG. 2, which transom is unnumbered but which forms the rear portion of the hull 32.

A tunnel 43 is recessed into the central rear portion of the hull 32 and contains a jet propulsion unit, shown in broken lines in FIG. 2 and identified generally by the reference numeral 44. The jet propulsion unit 44 may be of any known type and includes a downwardly facing water inlet opening 45 through which water is drawn by the action of an impeller 46 and is discharged rearwardly through a discharge nozzle 47 upon which a pivotally supported steering nozzle 48 is supported for propelling the watercraft 31 and steering it. The way in which the steering nozzle 48 is steered will be described later.

The jet propulsion unit 44 includes an impeller shaft 49 to which the impeller 46 is affixed and which extends forwardly through a bulkhead 51which defines the front of the tunnel 43. The impeller shaft 49 is there drivingly mated to a drive shaft 52 which continues to extend forwardly under the passenger's compartment 33 into a forwardly positioned engine compartment in which an internal combustion engine 53 of any known type is positioned. The output shaft of the engine 53 is connected to the drive shaft 52 by a suitable elastic coupling, as in a manner well known in this art. Forwardly of the engine 53, there is provided a centrally positioned fuel tank 54 that supplies fuel to the induction system of the engine 53 in any well known manner. The fuel tank 54 has a fill neck 55 that is accessible through a front deck 56 of the watercraft hull 32.

A removable engine cover 57 is affixed to the deck 56 in any suitable manner to a forwardly pivoted hatch 60 covering the engine compartment, engine 53, fuel tank 54 and other components of the watercraft that are contained within the engine compartment. The cover 57 may be formed from any suitable material, such as a molded fiberglass reinforced resin.

A watercraft control, indicated generally by the reference numeral 58 is provided for controlling the pivotal position of the steering nozzle 48 and also the speed of the engine. This control 58 is supported in such a way that it can be either positioned centrally as shown in the solid line view of the various figures or in a side position as shown in phantom line views so as to permit control of the watercraft either from the operator seated centrally on the seat 34 or seated at either side thereof. This control 58 and the manner in which it operates and may be moved will now be described by particular reference to FIGS. 4 through 6.

The control and its support include a forwardly positioned supporting bracket 59 that is affixed in a suitable manner to the aforenoted engine hatch 60 forwardly of the engine 53 and above it. The support bracket 59 carries a pivot pin 61 on which a sleeve 62 having a rearwardly extending tab 63 is journaled for rotation about a transversely extending generally horizontal pivot axis. The reason for the pivotal movement will be described.

A pair of rearwardly extending support links 64 and 65 have forward ends that are pivotally connected to the portion 63 by vertically extending pivot pins 66. The support links 64 and 65 provide, as will become apparent, a parallelogram linkage system.

At their rear ends, the supporting links 64 and 65 are pivotally connected to a supporting assembly, indicated generally by the reference numeral 67 by means of pairs of pivot pins 68. The supporting bracket 67 is made up of a number of interconnected members and includes a downwardly extending locating pin 69 that is adapted to be received in a selected one of three apertures 71 formed in the hull 32. The central of these apertures 71 is positioned forwardly and centrally of the seat 34 while the remaining two apertures 71 are disposed forwardly of the respective sides of the seat 34 and at slightly lower vertical positions for a reason which will become readily apparent.

A steering shaft 72 is journaled in the supporting assembly 67 and has a handle bar assembly 74 affixed to its rear end in a suitable manner. The steering shaft 73 has either affixed to it or formed integrally with it a bevel gear 75 which is enmeshed with a further bevel gear 76 affixed to a generally vertically extending shaft 77 that is journaled for rotation about an axis that extends perpendicularly to the axis of rotation of the steering shaft 73 and the supporting bracket 67. The shaft 77 has affixed to it a crank arm 78 to which one end of a bowden wire cable 79 is affixed by means of a suitable coupling 81. The bowden wire cable 79 extends forwardly and is supported by means of a supporting bracket assembly 82 that is affixed in a suitable manner to the mounting bracket 67. The bowden wire cable 79 extends through a flexible boot 83 positioned forwardly in an area adjacent the pivot pin 67 and then bends rearwardly and is connected in a suitable manner to the steering nozzle 48 for steering of it in response to pivotal movement of the handle bar assembly 74.

A throttle control 84 is supported on the handlebar assembly 77 and is, in turn, connected to a bowden wire cable 85 which also extends forwardly and through the boot 83. The other end of the bowden wire cable 85 is connected to the throttle control of the engine 53 in a well known manner.

The supporting bracket 67 further includes a toggle type lock 86 which cooperates with any one of three associated keepers 87 either positioned centrally of the seat 34 or at somewhat lower vertical positions and the respective sides thereof. The cooperation of the toggle type lock 86 and the pins 69 and openings 71 provides a rigid lock for the control 58 in either its central position or its side positions. It should also be noted that if it is desired to access the engine 53 when the engine cover 57 is removed, the control assembly 58 may be easily pivoted up out of the way along with the pivotably supported hatch 60 upon which it is mounted by releasing the toggle lock 67 and a rear lock, which holds the rear of the hatch down. As a result of this construction, the control is very effective and is accessible from selected control positions without interfering with access to the engine 53 or other components located in the engine compartment.

It should also be noted that the parallel linkage system provided by the support links 64 and 65 maintains the axis of the steering shaft 73 perpendicular to the seat 34 regardless of which position the control 58 is placed in. Also, because of the parallelogram action of the links 64 and 65, the control 58 will be positioned closer to the seat 34 in its central position than in its side positions. Thus, the pivotal movement of the control 58 not only permits adjustment of the side to side position, but also varies the length between the control 58 and the seat 34 so as to accommodate riders of different stature and also to provide further room for the operator's legs when seating in the side positions. This difference in length is indicated by the dimension L in FIG. 1. As noted, the side positions for the control 58 are slightly lower than the central position.

Figure 7:
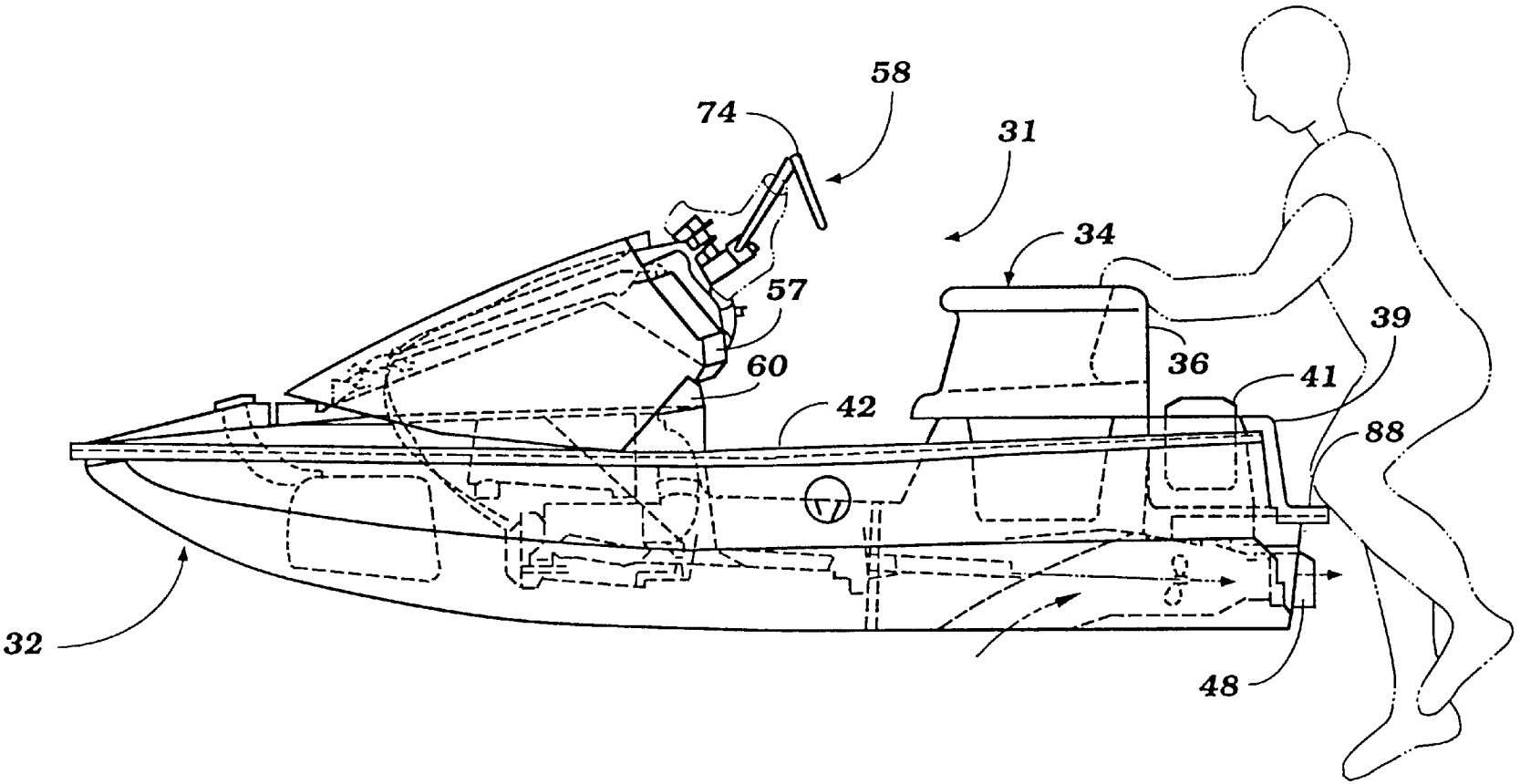
FIG. 7 is a side elevational view, in part similar to FIG. 2, and shows how a rider may enter the watercraft from the rear.
Figure 8:
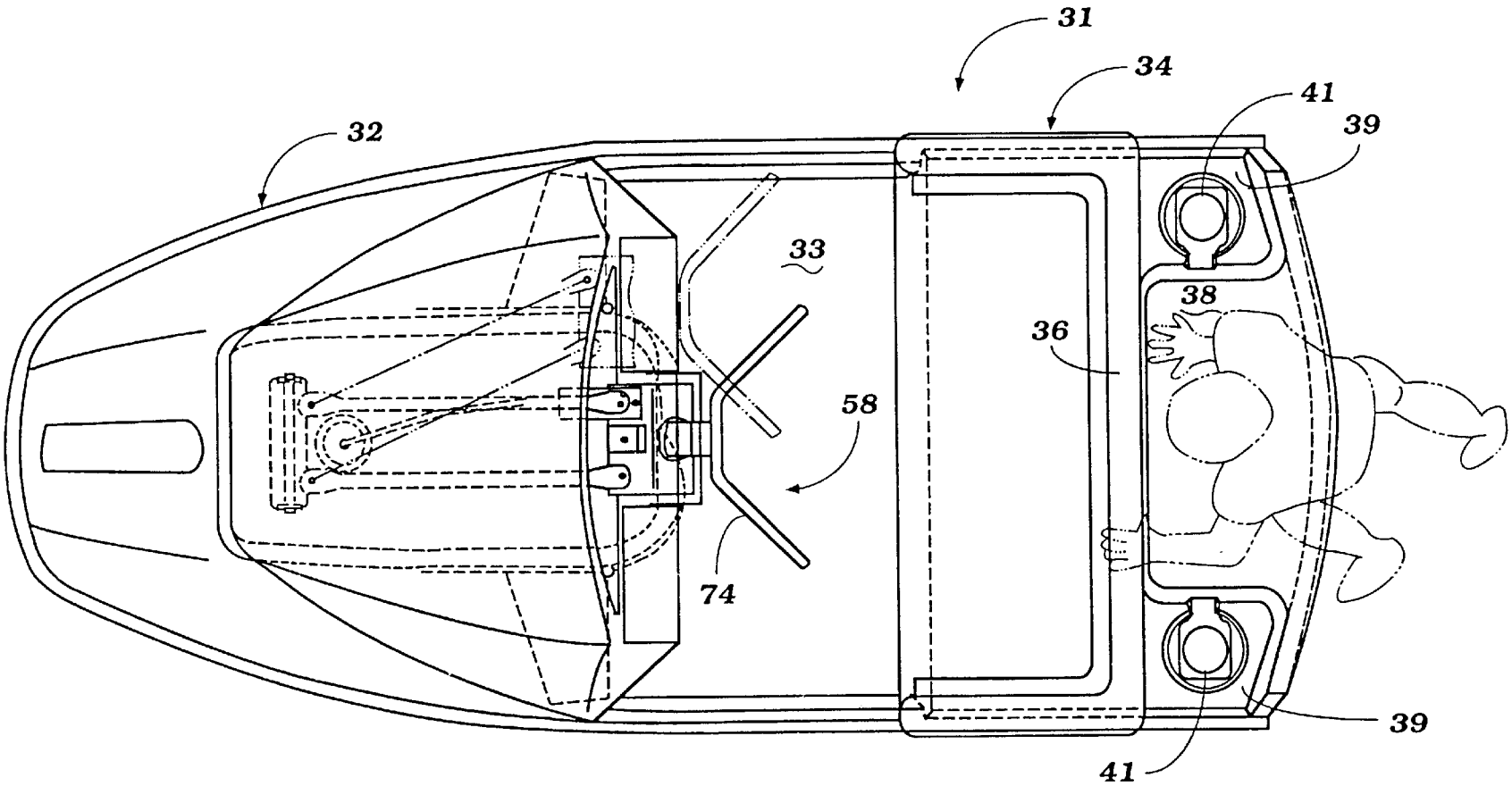
FIG. 8 is a top plan view, in part similar to FIG. 1, showing the rider entry.

A way in which the watercraft 31 may be easily boarded from the body of water in which it is operating may be understood best by reference to FIGS. 7 and 8. It has been previously noted that the deck 38 and particularly its central portion is opened rearwardly of the watercraft 31 and below the upper ends of the gunnels 42. There is, in fact, a rearwardly extending lip 88 formed that will permit a person, shown in phantom in FIGS. 7 and 8, to easily enter the watercraft 31 from the rear. The person can grasp the seat back 36 which functions also as a boarding handle, place their knee on the lip 88 and enter the rear deck 38. Since the deck 38 is centrally positioned and the buoyant areas 39 are formed on opposite sides of the deck 38, there will be considerable stability and any tendency to capsize the watercraft 31 will be avoided.

Figure 9:
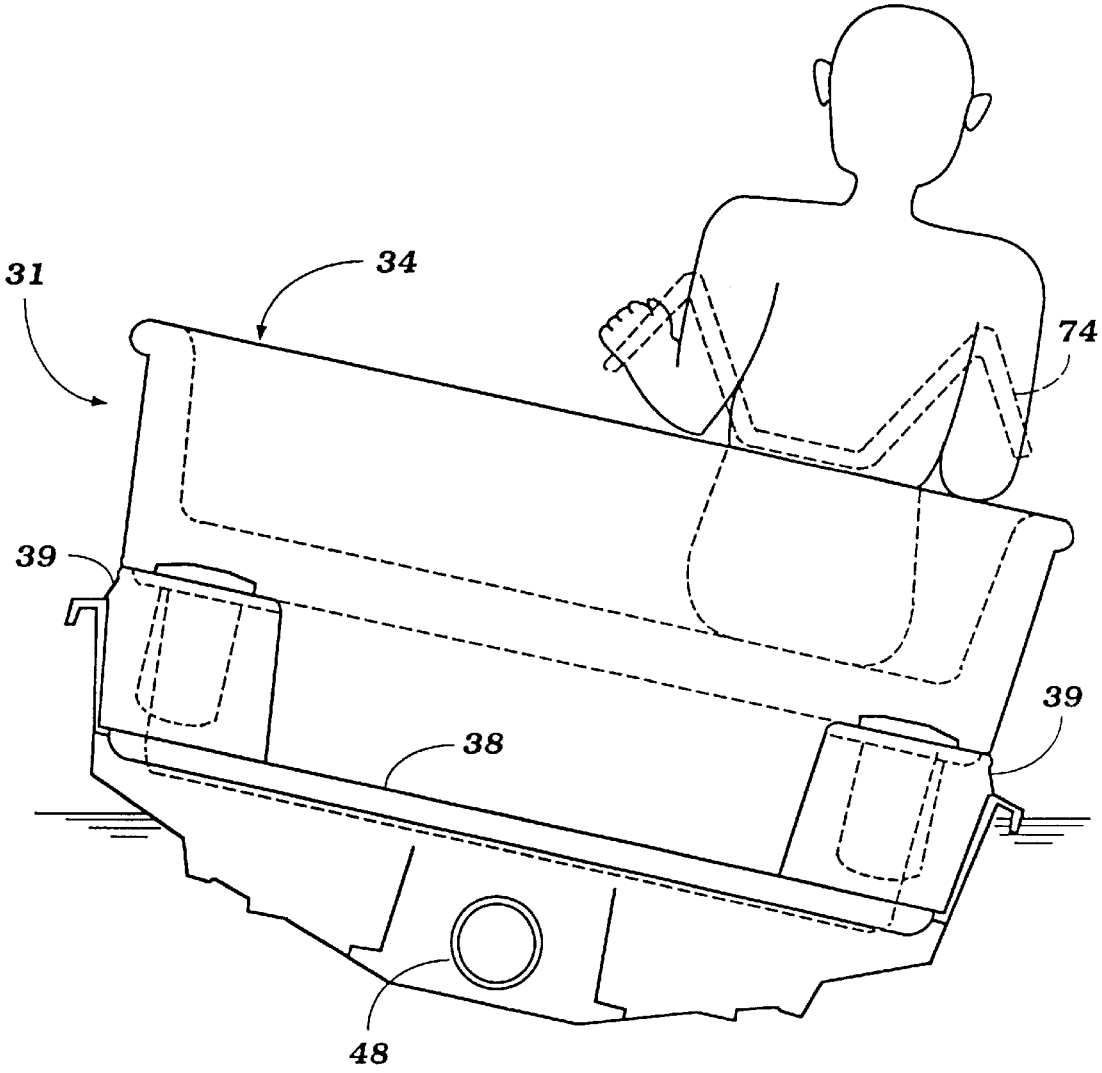
FIG. 9 is a rear elevational view showing how the watercraft is prevented from capsizing if a single rider assumes a side control position.
Figure 10:
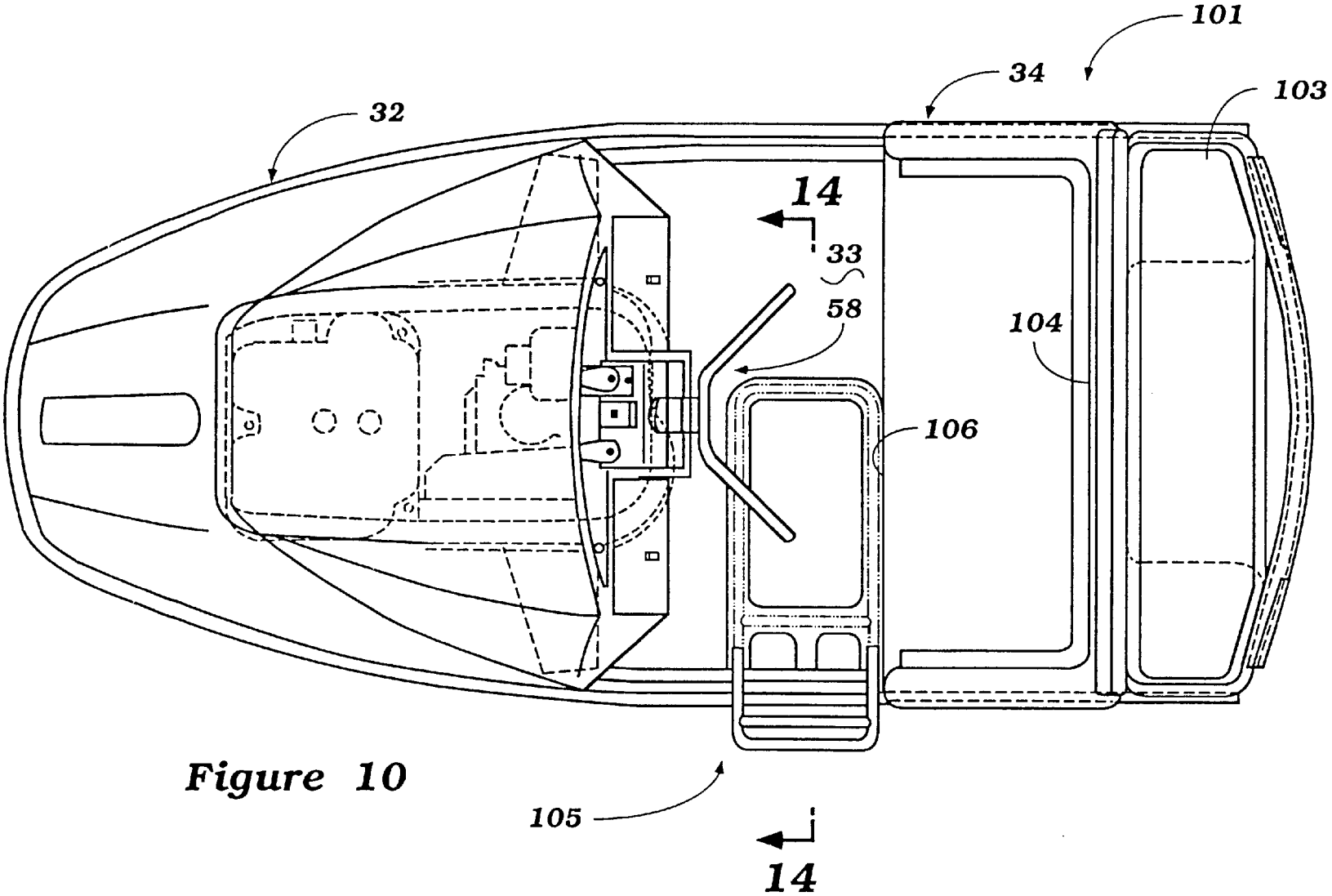
FIG. 10 is a top plan view, in part similar to FIG. 1, and shows another embodiment of the invention.

As may also be seen in FIG. 9, the use of the buoyant elevated areas 39 on the opposite sides of the deck 38 will permit a rider to operate the watercraft singly from a side position without the watercraft being capsized.

FIGS. 10 through 15 show another embodiment of the invention wherein the watercraft constructed in accordance with this embodiment is identified generally by the reference numeral 101. Many components of the watercraft 101 are the same as those of the previously disclosed embodiments and, in fact, the illustrations of this embodiment show some components of the watercraft in more detail than were illustrated in the previously described embodiment. Those components will be described first. Any components which are not described in this embodiment can be assumed to have the same construction as the previously described embodiment. For that reason, those components have been identified by the same reference numerals.

Figure 11:
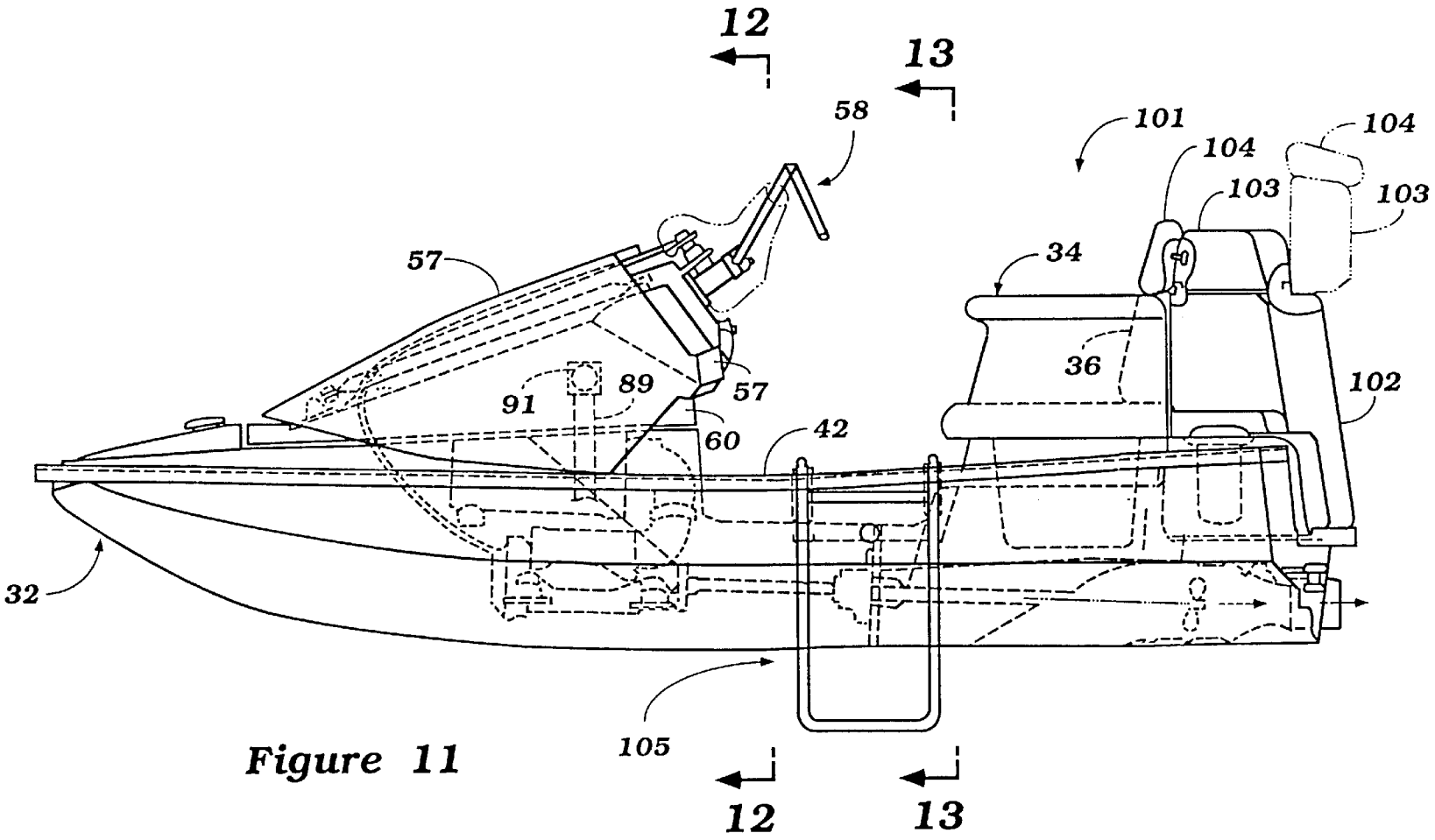
FIG. 11 is a side elevational view of the embodiment of FIG. 10.
Figure 12:
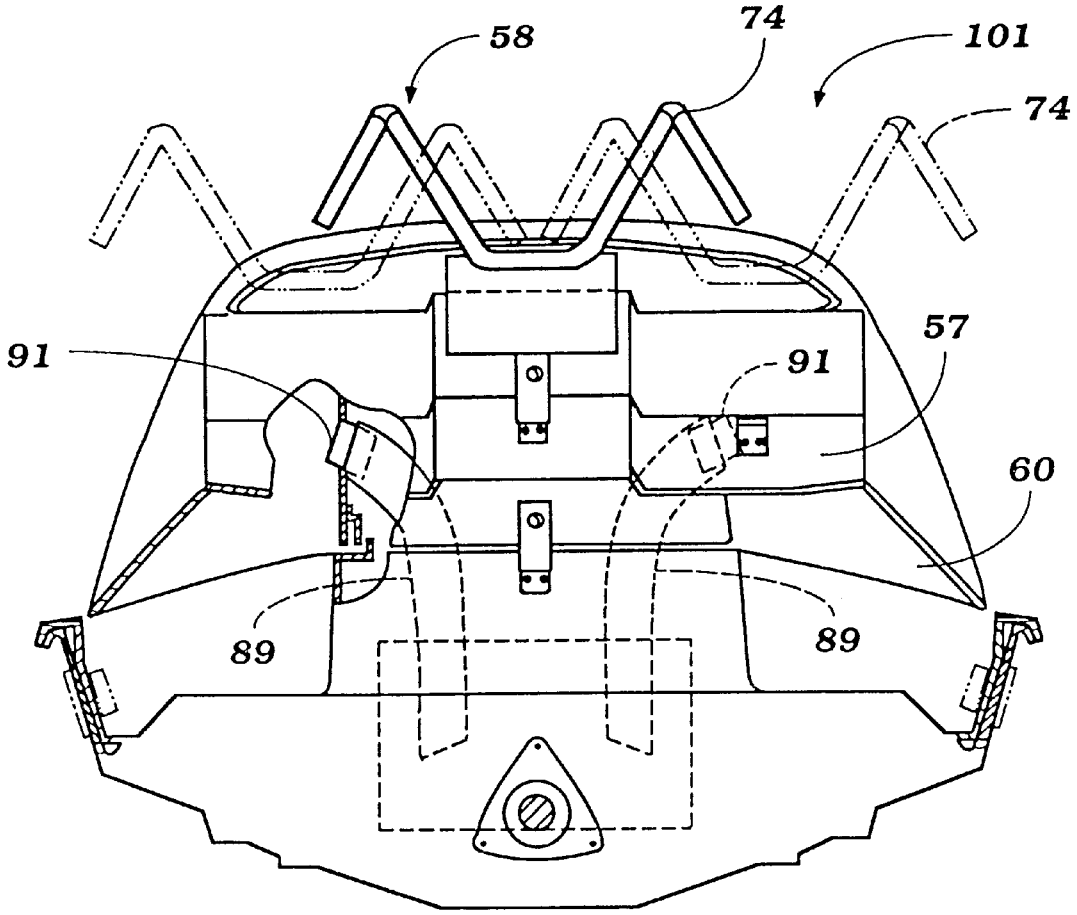
FIG. 12 is a cross sectional view taken along the line 12—12 of FIG. 11.
Figure 13:
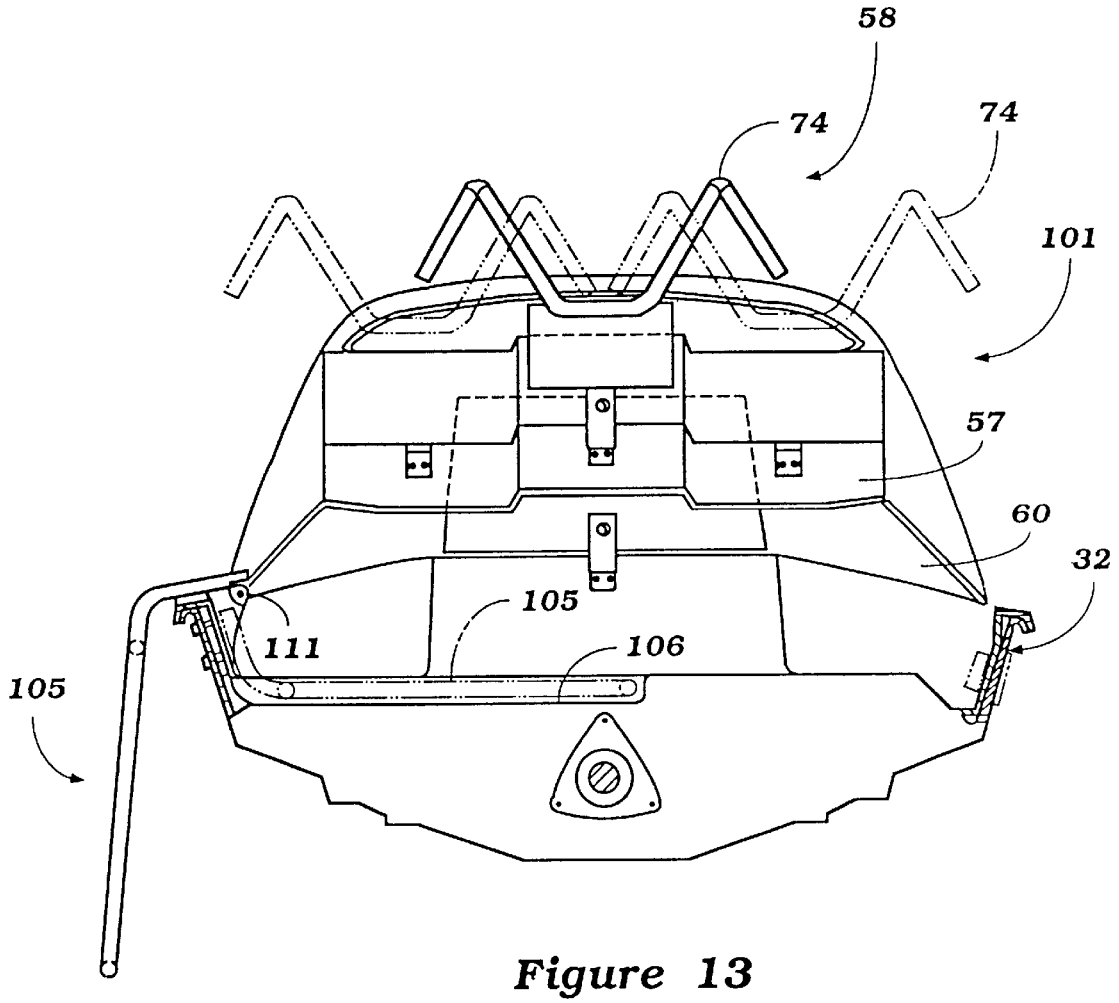
FIG. 13 is a cross sectional view taken along the line 13—13 of FIG. 11 and shows the storage position for the boarding ramp in phantom line views.
Figure 14:
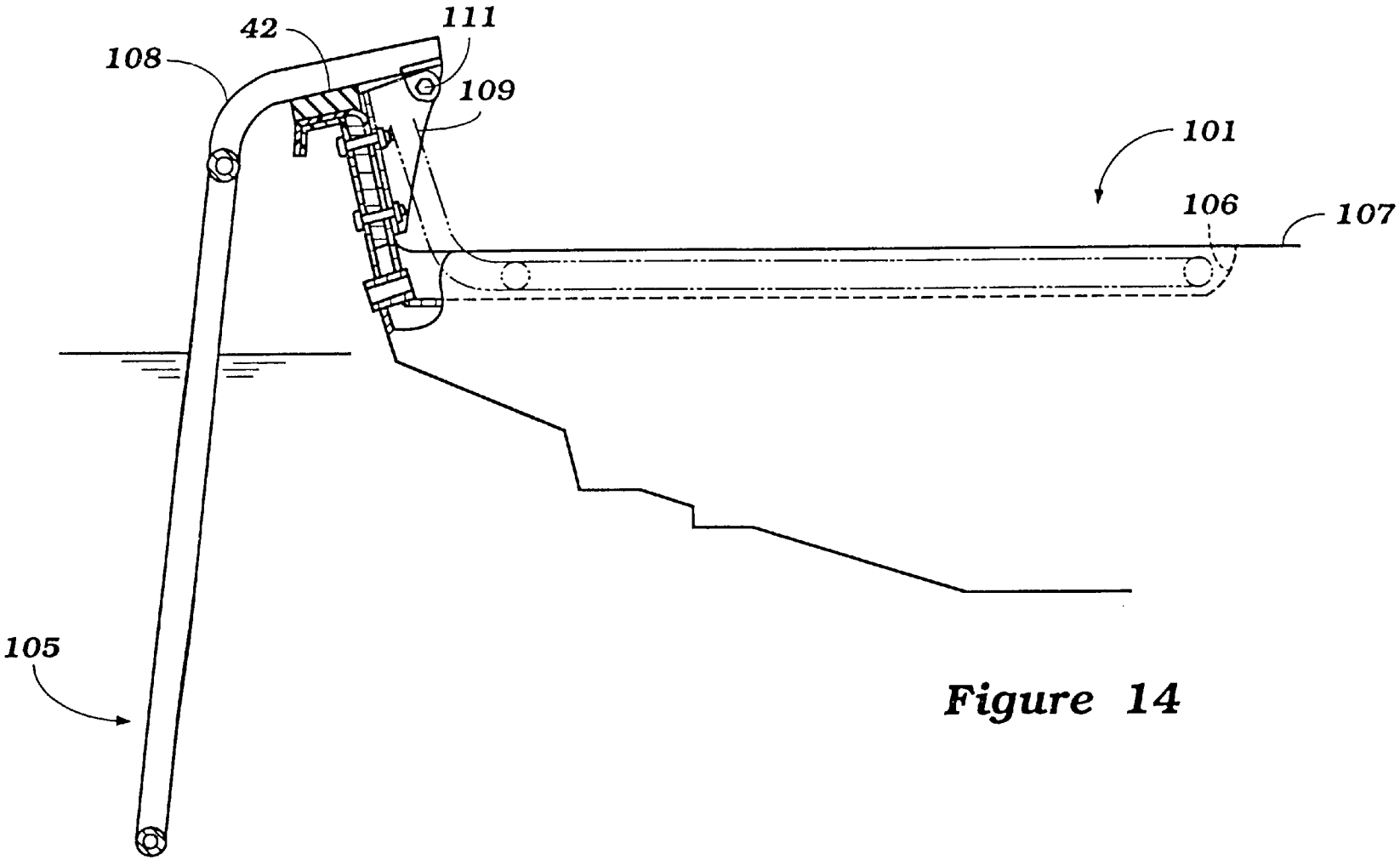
FIG. 14 is an enlarged cross sectional view taken along the line 14—14 of FIG. 10 and shows the boarding ramp in its boarding position in solid line views and in its storage position in phantom line views.
Figure 15:
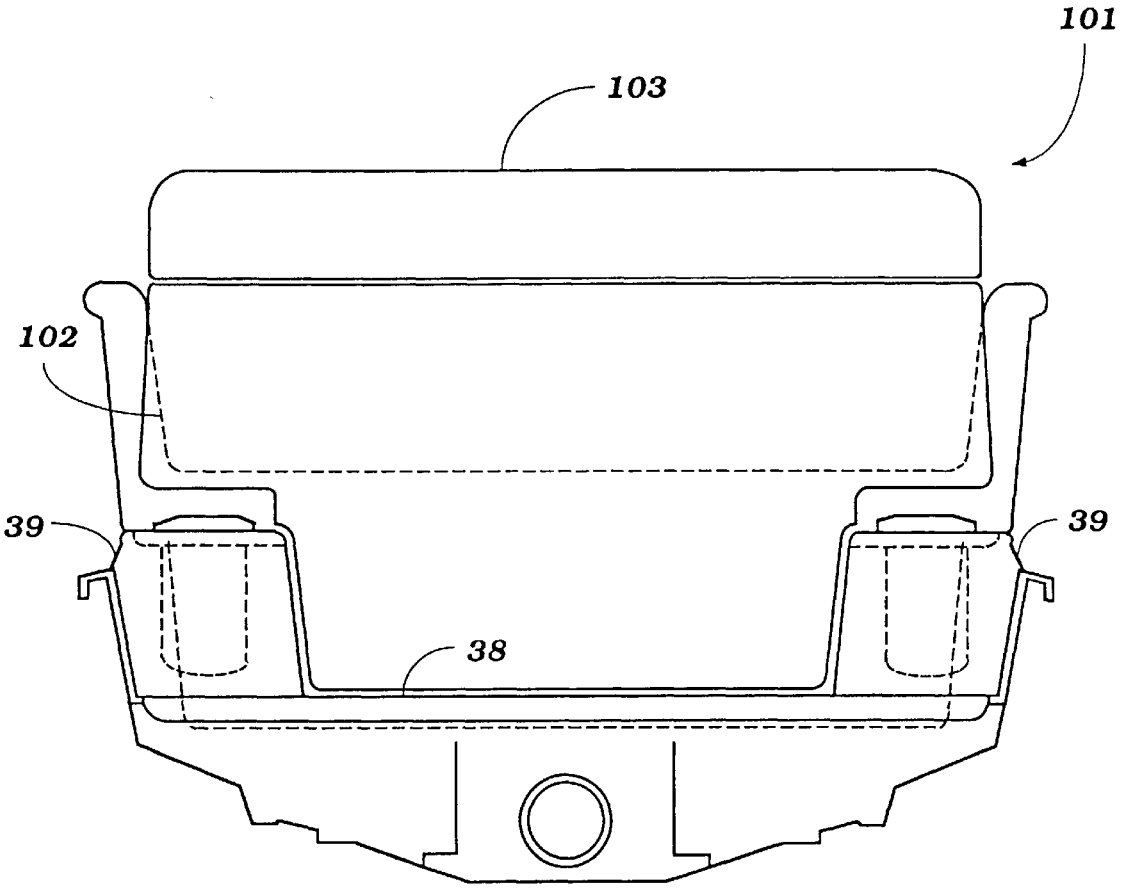
FIG. 15 is a rear elevational view of this embodiment.

FIGS. 11 and 12 of this embodiment the air vent system for the engine compartment of the watercraft wherein there are provided a pair of vent pipes 89 which extend upwardly and outwardly from the engine compartment and which terminate in inlet or exhaust ducts 91 that are positioned to be concealed within the engine cover 57 but which easily communicate with the atmosphere. Because of this concealed arrangement from the engine cover 57, however, it will insured that water cannot inadvertently enter the engine compartment.

In this embodiment, the rear deck 38 is occupied by a large storage compartment 102 that is disposed rearwardly of the seat 34 and specifically the seat back 36. This storage compartment 102 is accessible through a top mounted closure 103 which is pivotally connected at the rear end of the storage member 102 by suitable hinges for movement between a closed position as shown in the solid line view of the figures, and an open position as shown in phantom in FIG. 11. This closure 103 carries a head rest 104 which, when in the closed position, forms an extension of the seat back 36 and a head rest therefor.

Since boarding of the watercraft 101 from the rear deck is precluded by the storage compartment 102, a boarding device constructed in accordance with an embodiment of the invention and identified generally by the reference numeral 105 is provided. The boarding device 105 permits direct access to the rider's area 33 and specifically the area forwardly of the seat 44. The boarding device 105 is movable between a boarding position as shown in solid line views in the various figures and a storage position wherein it can be conveniently concealed in a recess 106 formed in the floor area 107 of the rider's compartment 33.

The boarding device 105 may constitute a tubular ladder and it has an L shaped portion 108 that has a pivotal connection to a hull mounted bracket 109 by means of a pivot pin 111 so that it may attached to the hull for movement between the boarding position and the storage position in substantial part within the recess 106. This obviously facilitates boarding from the body of water in which the watercraft is operating and, at the same time, will not intrude on the passenger's compartment 33 when not in use. If desired, the storage compartment 102 may be detachable connected to the hull so it can be removed so as to facilitate rear entry when the additional storage capacity is not required.

Figure 16:
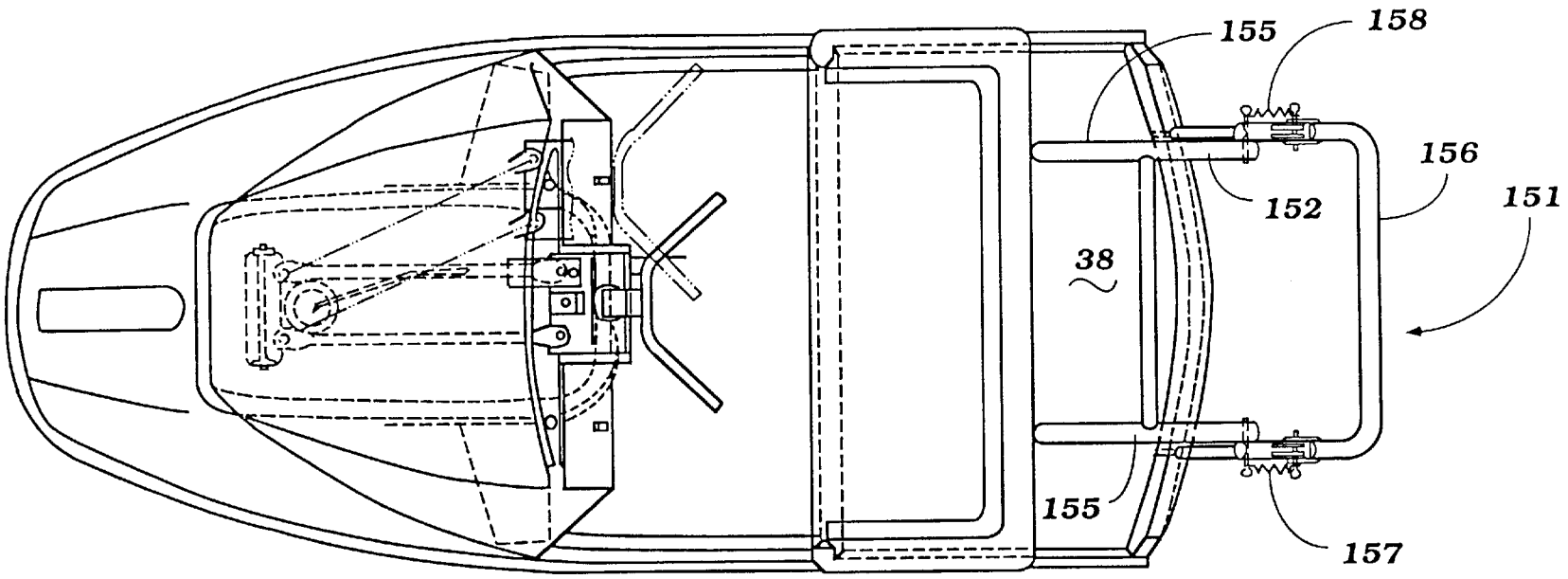
FIG. 16 is a top plan view, in part similar to FIGS. 1 and 10 and shows a third embodiment of the invention.
Figure 17:
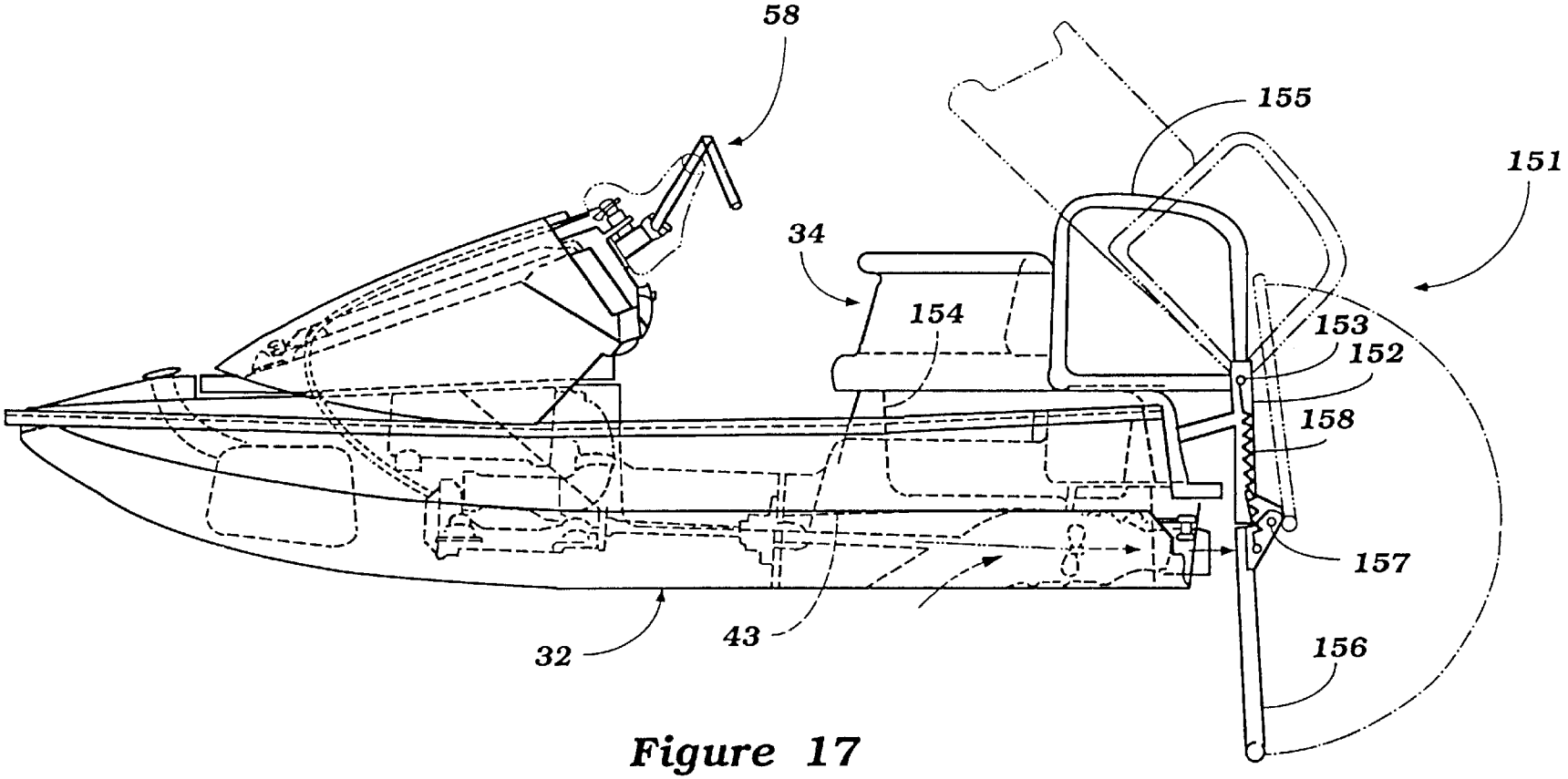
FIG. 17 is a side elevational view of this embodiment showing the boarding device in its operative position in solid lines and in its storage position in phantom lines, and the seat and storage compartment in its normal position in solid lines and in an access position in phantom lines.

FIGS. 16 and 17 show another embodiment of the invention which is generally similar to the embodiment of FIGS. 1 through 9 but which includes a boarding device, indicated generally by the reference numeral 151 which is positioned to assist in boarding through the rear deck 38. Since this is the only difference between this embodiment and the embodiment of FIGS. 1 through 9, only this portion of the watercraft will be described. The components which are the same as the previously described embodiments will be identified by the same reference numerals and not described again.

In this embodiment, however, the seat 34 is supported for pivotal movement on a mounting bracket assembly 152 that is fixed to the rear of the hull and adjacent the deck area 38 in a suitable manner. A pivot pin 153 is provided for this purpose. A storage compartment 154 is thus formed in the hull 32 above the tunnel 43 and beneath the seat 34.

A pair of side hand rails 155 are also fixed for this pivotal movement with the seat. The boarding device 151 includes a ladder part 156 that is pivotally connected to the bracket 152 by means of a hinge assembly 157 and which construction includes an over center spring 158 so as to yieldably hold the ladder 156 in its lowered boarding position as shown in solid line in the figures, or its elevated, out of the water position as shown in phantom line.

Figure 18:
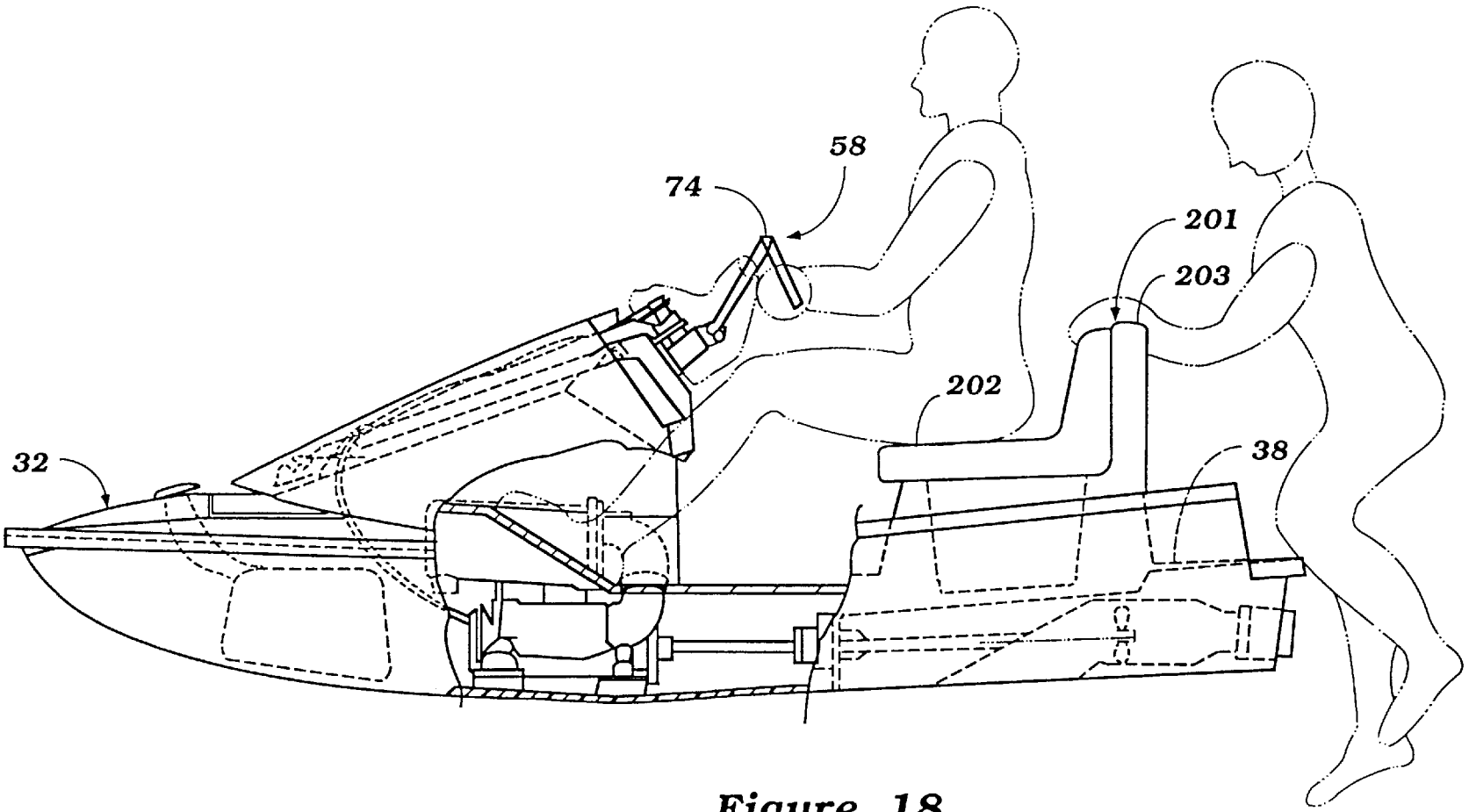
FIG. 18 is a side elevational view, in part similar to FIGS. 2, 11 and 17, showing a fourth embodiment of the invention and illustrating how a rider may enter with an operator in position.
Figure 19:
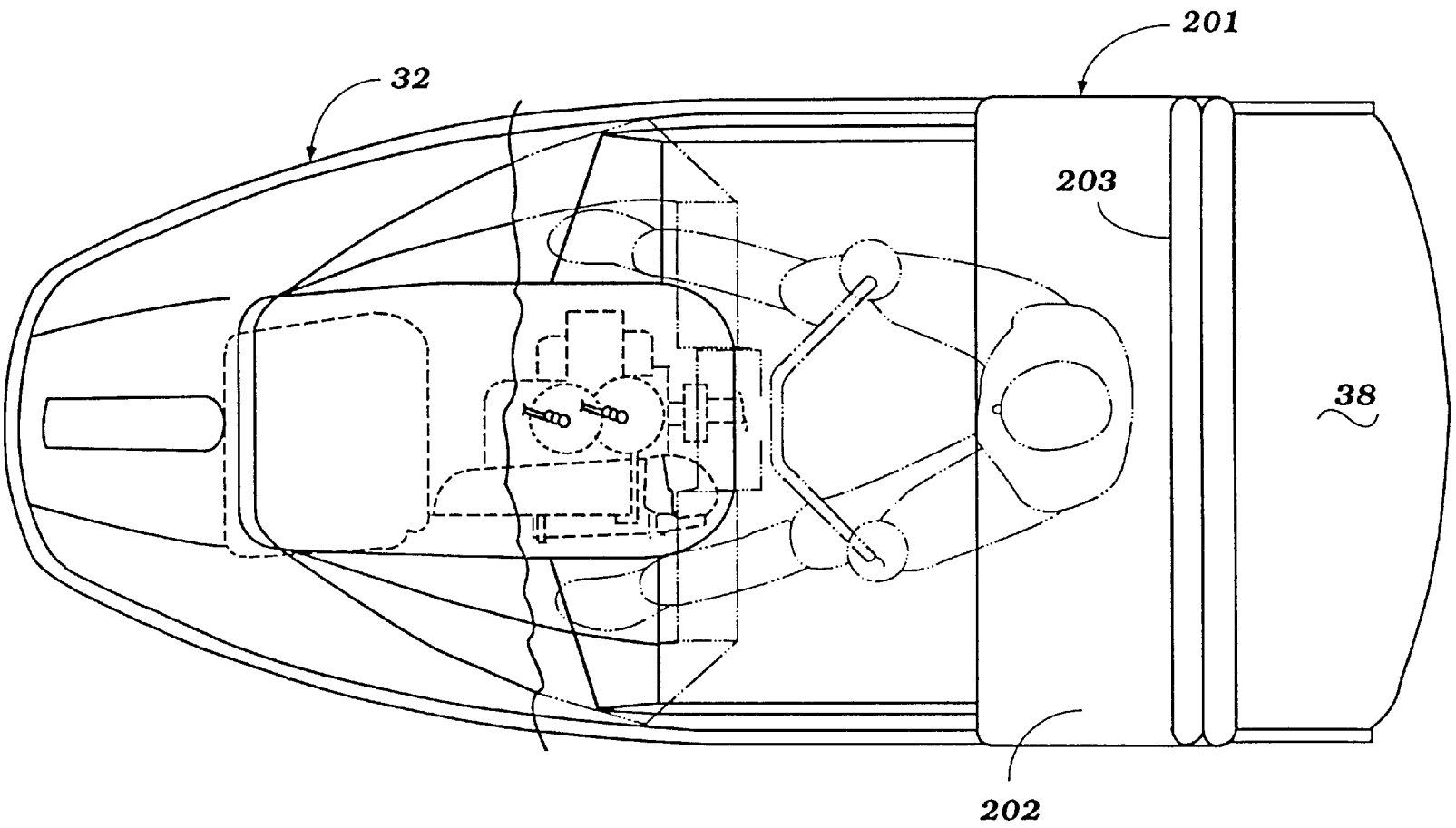
FIG. 19 is a top plan view of this embodiment.
Figure 20:
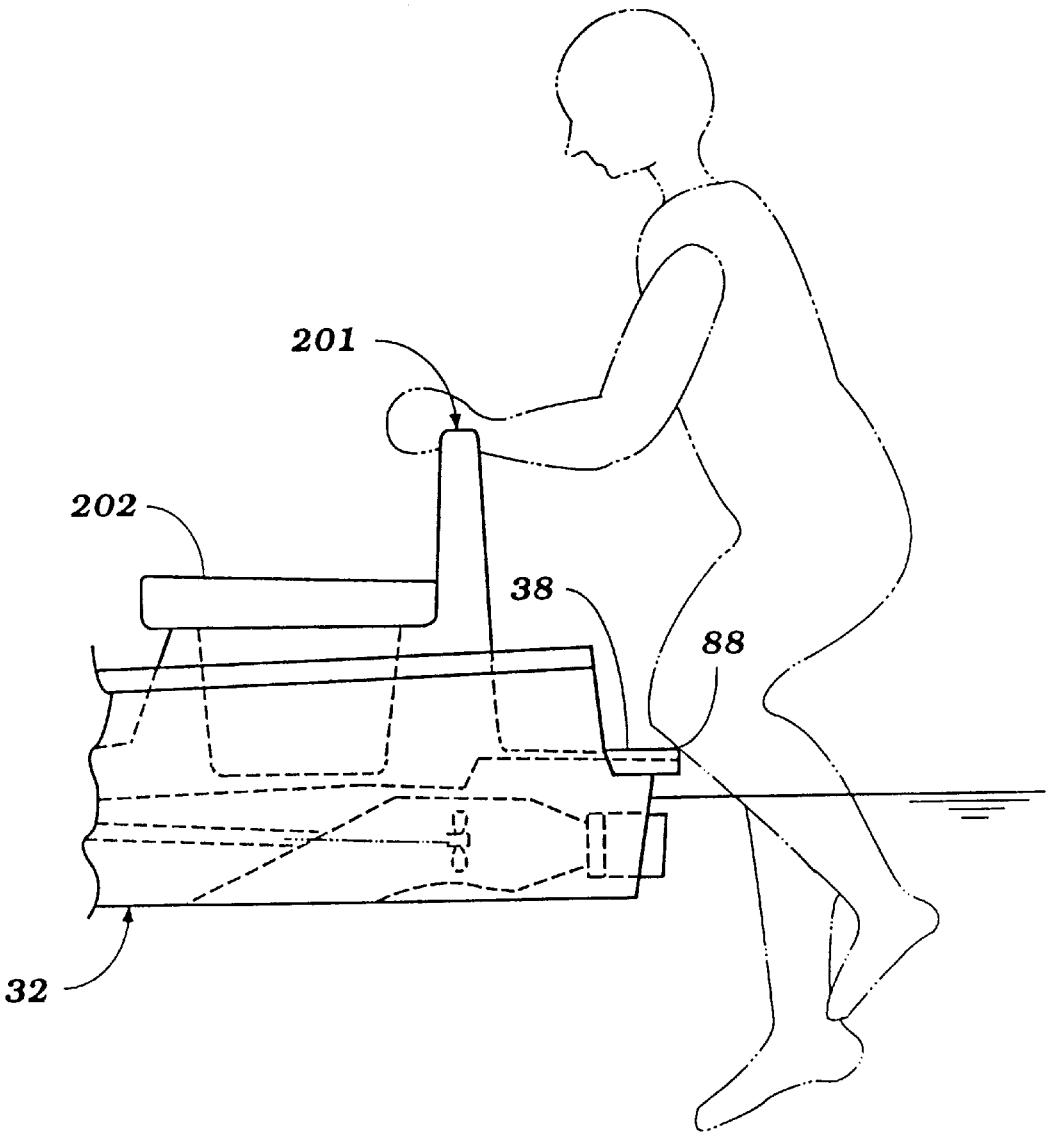
FIG. 20 is an enlarged side elevational view of this embodiment showing the rider entry.

FIGS. 18 through 20 show yet another embodiment of the invention which is generally the same as the embodiment of FIGS. 1 through 9. This embodiment differs from the previously described embodiment only in the construction of the passenger seat, which is indicated generally by the reference numeral 201 in this embodiment. For that reason, the remaining components of the watercraft have been identified by the same reference numerals and will not be described again.

In this embodiment, the seat 201 has a transversely extending seat cushion 202 that is adapted to accommodate either a single rider positioned centrally at one side thereof or a rider and passenger seated in side by side fashion. The seat 201 also has a seat back 203 that easily forms a handle to assist a passenger boarding the watercraft through the deck area 38 in the manner previously described. However, in this embodiment, seat 201 has no side bolsters so this will facilitate the rider or other passengers to enter on the seat from the rear. Of course, in all of the embodiments as previously described, the rider may stand on the deck area 38 during operation of the watercraft if he so desires.

Figure 21:
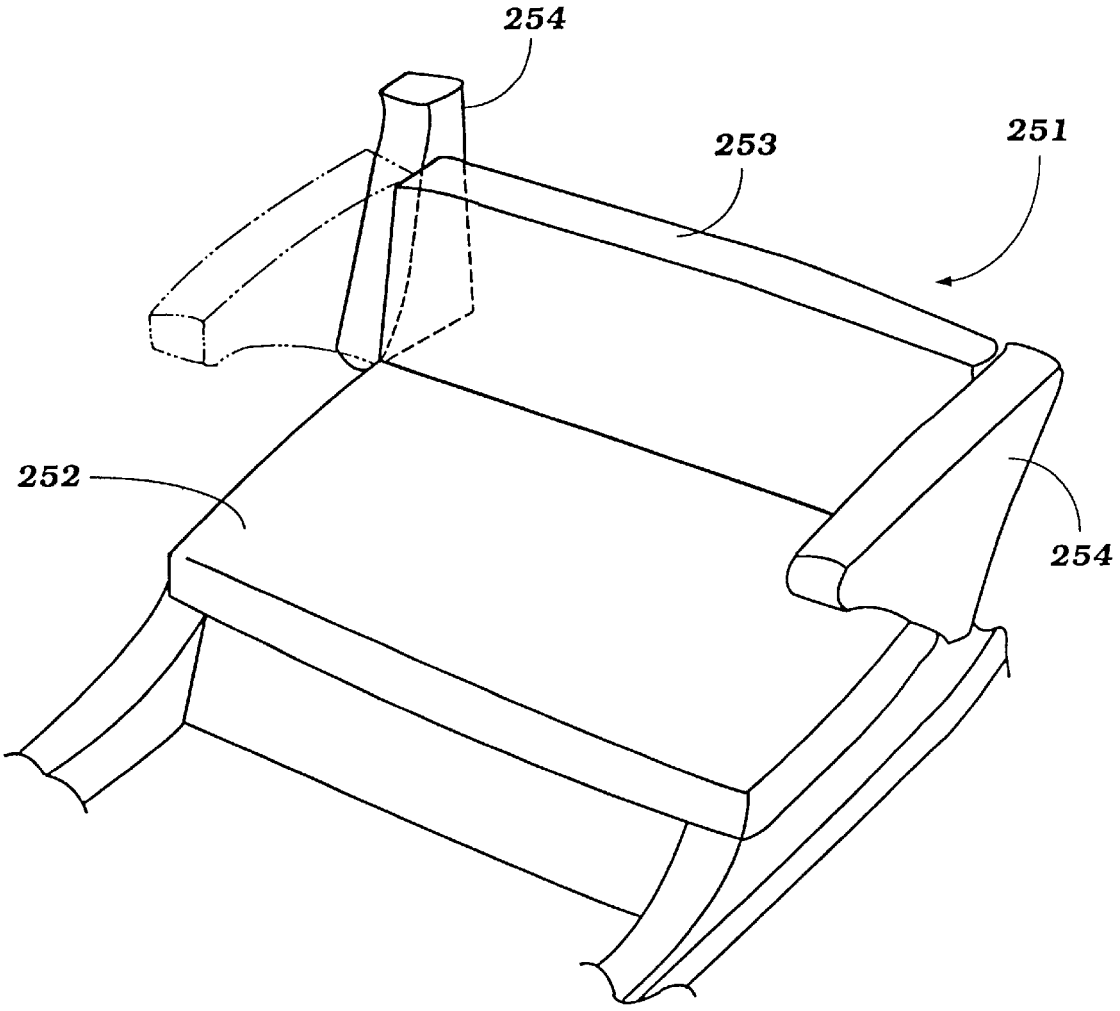
FIG. 21 is a perspective view of a further embodiment of seating arrangement that may be employed with watercraft to practice the invention.
Figure 22:
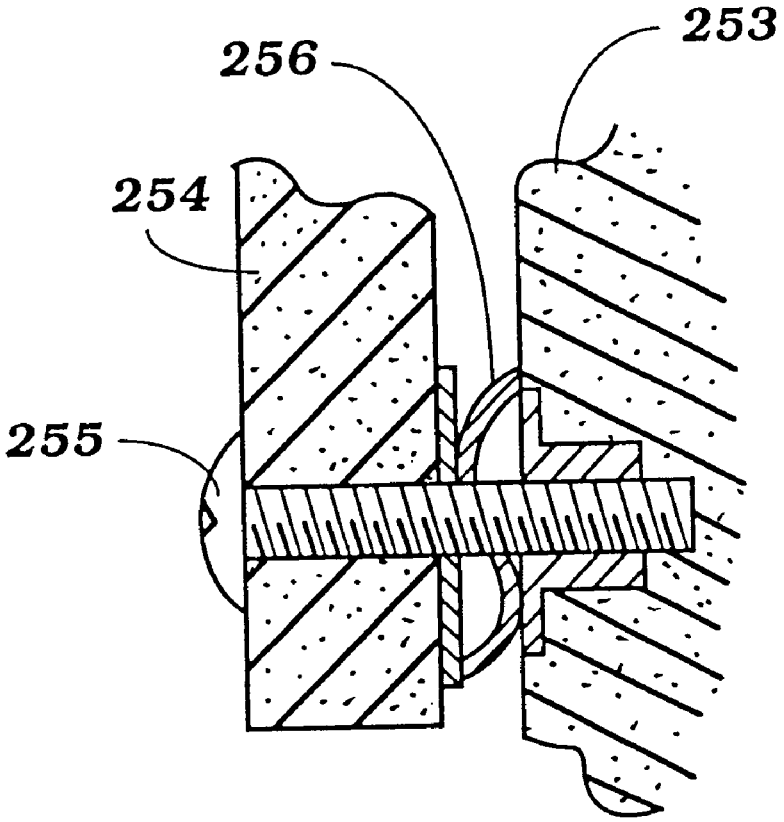
FIG. 22 is an enlarged cross sectional view showing the pivotal structure for the armrest in this embodiment.

FIGS. 21 and 22 show another seat which can be employed with any of the embodiments as thus far described and which seat provides not only side bolsters but ease of entry from the rear. Since this embodiment differs from the preceding embodiments only in the construction of the seat, this is all that is shown in the figures and the seat is indicated generally by the reference numeral 251. The seat 251 has, like the previously described embodiments, a cushion portion 252 that has sufficient width so as to accommodate either a single or two riders and permit the single rider to sit either centrally or at one side. In addition, the seat 251 has a backrest 253 that forms a grab handle to permit boarding of the rear deck area.

In this embodiment, there are provided a pair of side bolsters 254 which are pivotally connected to the seat back 253 by means of pivot bolt assemblies 255. Bellville washers 256 are disposed between the seat back 253 and the side bolsters 254 so as to yieldably maintain the side bolsters 254 in their normal operative positions or permit their pivotal movement, as shown in the left hand side of FIG. 21, to a raised position so as to facilitate side entry onto the seat cushion 252 without interference from the bolster 254.

Figure 23:
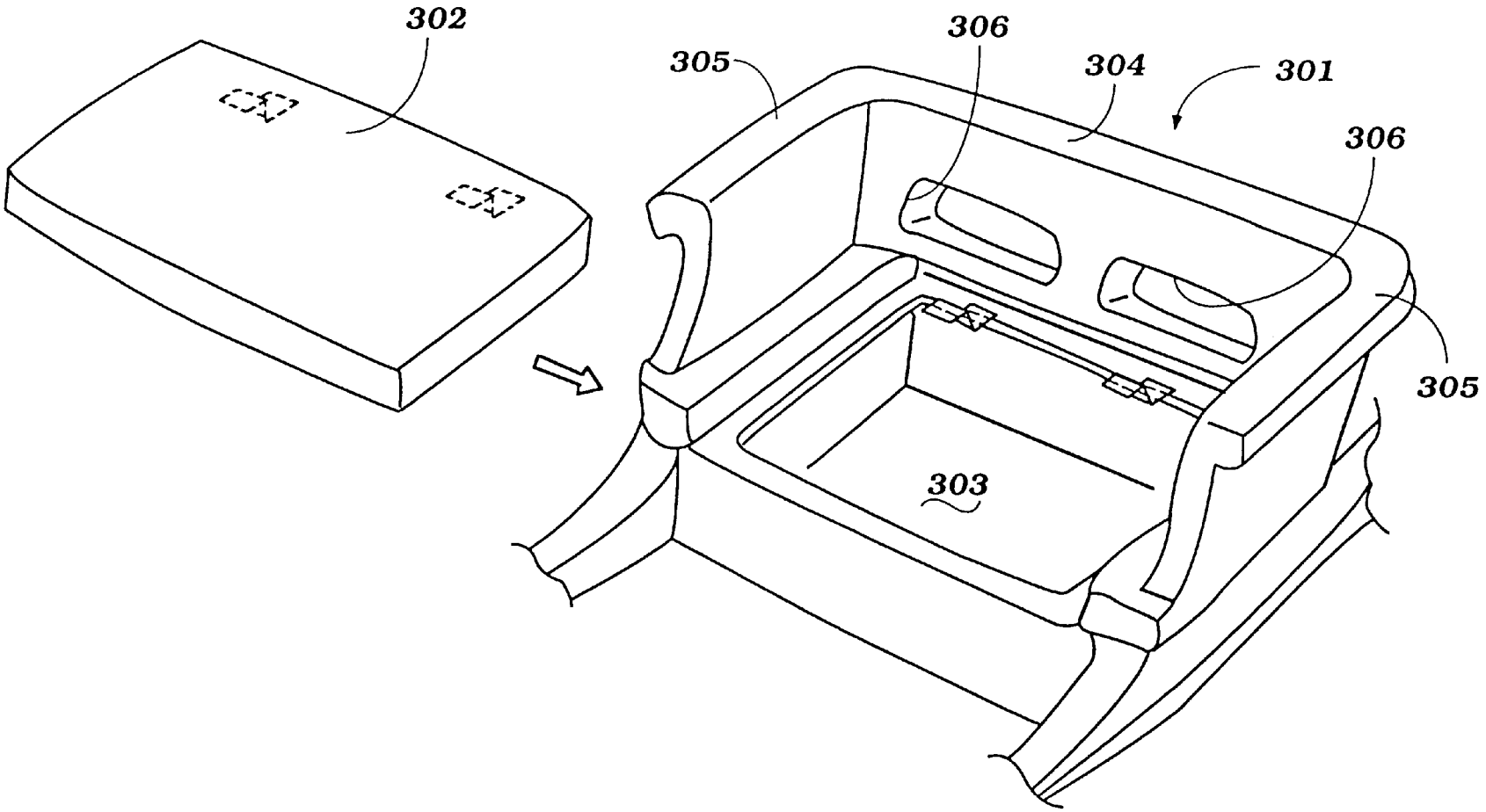
FIG. 23 is an exploded perspective view of a seat constructed in accordance with another embodiment of the invention.

FIG. 23 shows another seat embodiment, indicated generally by the reference numeral 301 which may be employed with any of the previously described embodiments. The seat 301 has a construction generally of the same type as the seat 34 of the embodiment of FIGS. 1 through 9. In this embodiment, however, the seat 301 has its cushion portion 302 removable so as to afford access to a storage compartment 303 formed thereunder. The seat 301 also has a back portion 304 which forms a grab handle so as to facilitate boarding of the watercraft through the rear deck area 38 as previously described. In this embodiment, like the embodiment of FIGS. 1 through 9, the seat 301 is also formed with side bolsters 305 to provide lateral support. Holes 306 are formed in the seat back 304 and serve two purposes. The first of these purposes is to permit any water to drain from the seat 301. The second is that the openings 306 also provide hand holes for a passenger to grasp to facilitate lifting themselves onto the deck 38.

It should be readily apparent from the foregoing description that the described embodiments permit selected control positions for the watercraft while maintaining the control in a generally perpendicular relationship to the seat and also while affording ease of access to the engine positioned beneath the control and its supports and varying positions between the control and the seat. In addition, various boarding arrangements have been disclosed which facilitate boarding and which also insure against capsizing, even if the rider decides to operate the watercraft solely and from a side position. Of course, the preceding description is that of preferred embodiments of the invention. Various changes and modifications may be made without departing from the spirit and scope of the invention, as defined by the appended claims.

I claim:

1. A watercraft having a hull defining a rider's area adapted to accommodate at least one rider therein, said rider's area being comprised of a floor having a transversely extending recess, and boarding means pivotally supported on a side of said hull adjacent said recess for facilitating the entry of a rider into said rider's area from outside of said hull, said boarding means being configured to nest at least in part in said recess when pivoted from a boarding position along the side of said hull to a storage position within said rider's area.

* * * * *